United States Patent [19]

Funk

[11] Patent Number: 5,037,049

[45] **Date of Patent: * Aug. 6, 1991**

[54] FOLDABLE, TREE-LIKE STRUCTURE FOR HANGING PLANTS

[76] Inventor: Jack N. Funk, 107 Overlake Dr. E., Bellevue, Wash. 98004

[ * ] Notice: The portion of the term of this patent subsequent to Aug. 6, 2007 has been disclaimed.

[21] Appl. No.: 432,387

[22] Filed: Nov. 6, 1989

[51] Int. Cl.[5] ..... A47G 7/02

[52] U.S. Cl. ..... 248/165; 248/167; 47/39

[58] Field of Search ..... 248/163.1, 163.2, 434, 248/435, 167, 175; 47/39, 67; 211/196

[56] References Cited

U.S. PATENT DOCUMENTS

| | | | |
|---|---|---|---|
| 1,243,173 | 10/1917 | Hinkley | 248/165 X |
| 1,357,250 | 11/1920 | Rau | 248/167 |
| 1,794,076 | 2/1931 | Jablons | 248/167 |
| 3,015,024 | 12/1961 | Charchan | 47/39 X |
| 3,708,144 | 1/1973 | Nasmith | 248/167 |
| 4,734,301 | 3/1988 | McKinney | 211/196 X |

FOREIGN PATENT DOCUMENTS

| | | | |
|---|---|---|---|
| 155256 | of 1954 | Australia | 248/163.1 |
| 6700426 | of 1968 | Netherlands | 248/163.1 |

*Primary Examiner*—Henry E. Raduazo
*Assistant Examiner*—Jerrold D. Johnson
*Attorney, Agent, or Firm*—Robert W. Jenny

[57] ABSTRACT

The structure is tree-like, having a tubular cruciform base, a vertical section and a plurality of tiers of limb-like structure, comprising a top tier, a bottom tier and at least one intermediate tier. The basic structure comprises one straight vertical tube and four bent tubular elements. The four elements each have a horizontal portion which is part of the cruciform base, a vertical portion which is part of the vertical section and an arched top which is part of the top tier of limb-like structures. The tubular elements are integrated by spacers and clamps. The clamps also retain tubular sockets which hold the tubular limb-like structures of the bottom and intermediate tiers. A swivelled snap hook is attached to the free end of each limb-like structure to support a hanging plant.

1 Claim, 2 Drawing Sheets

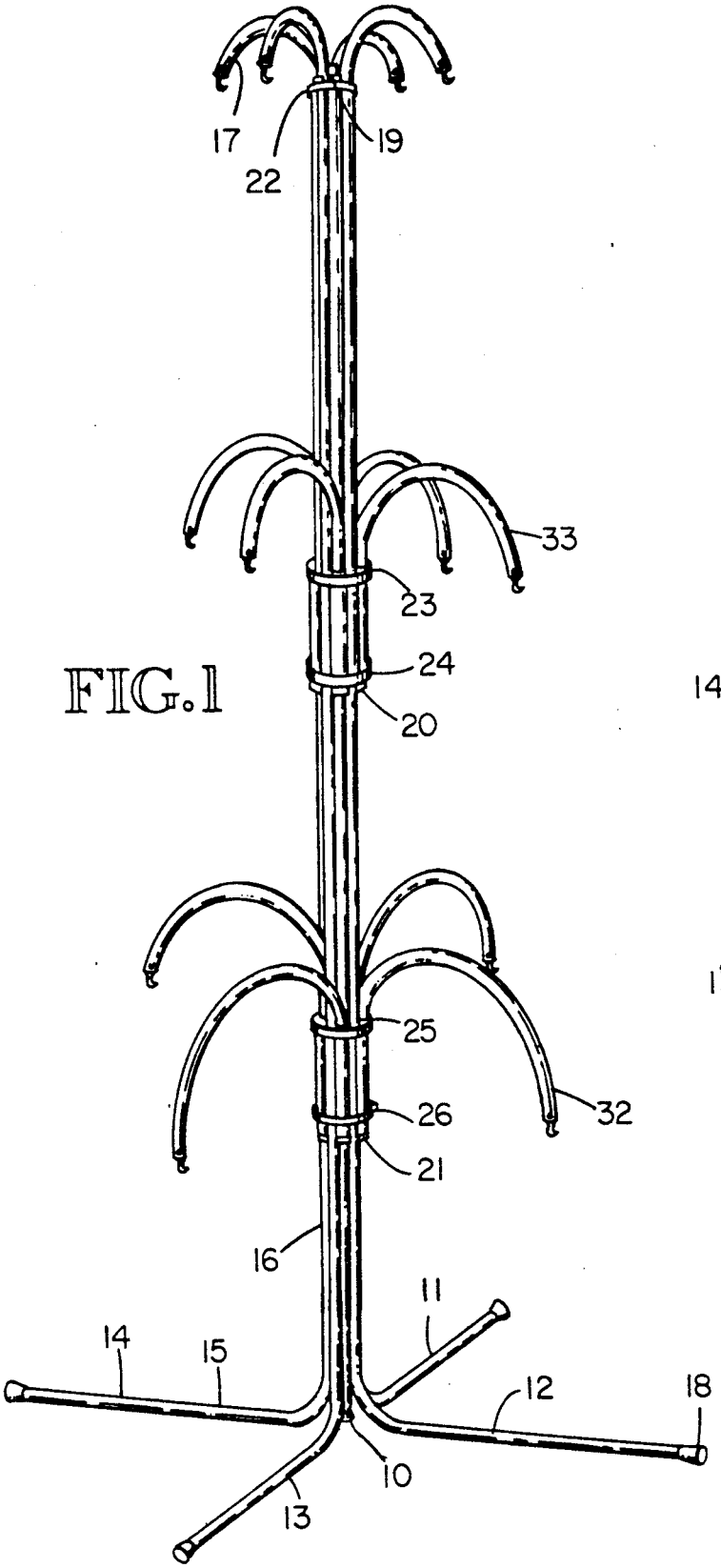
FIG. 1
FIG. 2
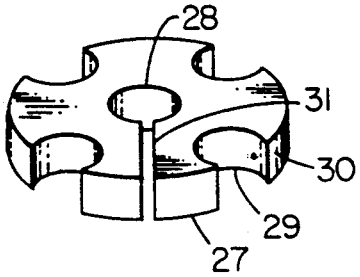
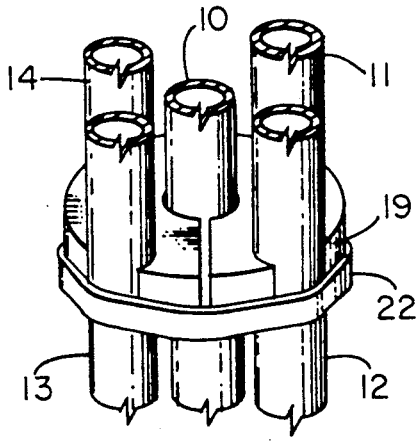
FIG. 3

FOLDABLE, TREE-LIKE STRUCTURE FOR HANGING PLANTS

BACKGROUND OF THE INVENTION

1. Field

The subject invention is in the field of structure for supporting clothes, displays, plants and the like, particularly foldable structure. More particularly it is in the field of such structure for supporting a plurality of potted plants. Still more particularly it is in the field of such structure which resembles a tree, having a trunk and limbs.

2. Prior Art

The patents listed below comprise the patented prior art known to the inventor.

| | | |
|---|---|---|
| *1,073,763 | | 3,708,144 |
| 1,357,250 | | 3,786,766 |
| *1,243,173 | | 3,908,564 |
| *1,794,076 | | 3,955,787 |
| | 4,582,282 | |

The asterisked patents are considered to be the known patented prior art closest to the subject invention, all showing structures resembling trees in that they have elements representing trunks and limbs and in that two of the structures are collapsible to a degree. However, none are particularly adapted to support hanging plants as well as being foldable into a flat configuration involving no loose parts. Accordingly, the prime objective of the subject invention is to provide a tree-like structure for supporting hanging plants. A second objective is that the structure be foldable into a flat configuration for convenience and cost savings in shipping and storage. A third objective is that there be no loose parts involved in the folding and unfolding, this feature facilitating the folding and unfolding as well as the shipping and storage. The tree-like configuration is considered important for aesthetic reasons.

A fourth objective is that the structure be easily manufactured from commercially available material and parts with a minimum requirement for specially made parts.

SUMMARY OF THE INVENTION

The subject structure comprises a four legged base, a vertical portion simulating a trunk of a tree and a plurality of limb-like components arranged in a plurality of tiers spaced along the vertical portion. The limb-like components are arched so that their free ends to which the plants are attached point essentially downward.

The vertical structure comprises five tubular components held in the desired special relationship to each other by a plurality of spacers and a plurality of commercially available hose clamps. Considering the stand erected for purposes of description, four of the five tubular elements comprise a horizontal segment, a vertical segment and an arched segment. The vertical segments are held equally spaced from each other and parallel to each other by the spacers and clamps. The horizontal segments extend radially from the bottom of the cluster of vertical sections to form the base of the structure. The arched segment, vertical segment and horizontal segment in each of the four elements lie in a flat plane and the arched segments comprise the top tier of limb-like structures extending radially from the top of the cluster of vertical segments. The arched segments have approximately a 180° arc length. The fifth tubular component is straight, parallel to the vertical segments and is positioned in the center of the cluster of vertical segments, extending through holes in the centers of the spacers.

In a preferred embodiment there are three tiers of limb-like structure, termed limbs for purposes of this disclosure, the top tier, an intermediate tier and the bottom tier. The intermediate tier and bottom tier are structurally similar, the length of the limbs of the intermediate tier being intermediate to the length of the limbs of the top and bottom tiers, the bottom tier limbs being longest. Each of the intermediate and bottom tiers comprises four tubular sockets resting endwise on a spacer, nested between the four vertical segments and held in place by the clamps. There is a limb fitting into each socket, each such limb comprising a straight portion and an arched portion, having approximately a 180° arc length. The straight portion of each of these limbs fits snugly but freely into a socket with the arched portion upward and extending radially from the cluster of vertical segments. These socket mounted limbs pivot in the sockets for adjustment of their radial position.

A commercially available spring clip with a swivel is attached to the end of each limb to accept the wire, handle or the like of hanging plants.

The invention is described in more detail below with reference to the attached drawings.

BRIEF DESCRIPTION OF THE DRAWINGS

FIG. 1 is a perspective view of a preferred embodiment of the invention.

FIG. 2 illustrates a spacer.

FIG. 3 illustrates a spacer and the relative orientation of the vertical portion of the invention installed in the spacer.

DETAILED DESCRIPTION OF THE INVENTION

Figure 4:
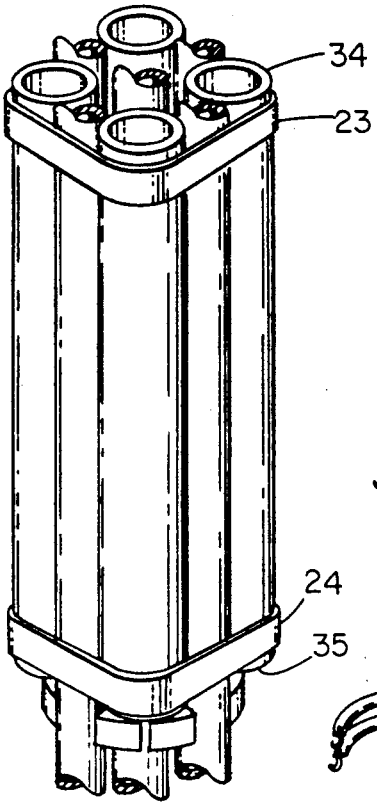
FIG. 4 illustrates the installation of the sockets for the bottom and intermediate tiers of limbs.

The subject invention is a tree-like structure for supporting hanging plants. It has a base, a trunk-like vertical section and a plurality of tiers of limb-like structures termed limbs for purposes of this disclosure. The tiers comprise the bottom and top tiers and at least one intermediate tier. Swivelled snap hooks are attached at the ends of the limbs to support the plants.

Referring to FIG. 1, a perspective view of a preferred embodiment of the structure, the primary elements of the structure are a straight tubular element 10 and four bent tubular elements 11, 12, 13 and 14, element 14 being typical and described in more detail. Element 14 comprises a horizontal base segment 15, normal to a vertical segment 16, and an arched segment 17, the arched segments of the bent tubular elements forming the top tier of limbs. The horizontal segments are disposed in a cruciform pattern to provide a stable base for the structure. The ends of the straight element and the horizontal segments are covered by elastomeric caps, cap 18 being typical. The tubular elements are held assembled by spacers 19, 20 and 21 and clamps 22, 23, 24, 25 and 26 as described below. The clamps are commercially available hose clamps.

FIG. 2 illustrates a spacer, which is a wafer 27 of material, preferably plastic, having a hole 28 at its center and 4 notches, notch 29 being typical, equally spaced around its periphery 30. The notches are somewhat more than semi-circular in plan view so that a snap fit of the tubes in the slots is provided. Slot 31 extends radially from hole 28 and allows for the spacer to be clamped tightly on element 11 by clamps described below.

FIG. 3 is a detailed view of the tubular elements in position in spacer 19 and held in place by clamp 22, this arrangement being typical for all the spacers except that the clamps for the bottom tier 32 and intermediate tier 33 of limbs are placed as shown in FIG. 4 which illustrates the installation of the sockets socket 34 being typical, into which the bottom and intermediate tier limb-like structures are inserted. The bent tubular elements are positioned with their base segments lying in a plane and in cruciform configuration when the structure is unfolded and ready to use. Each socket is a length of tubing having a longitudinal axis. The lower ends, end 35 being typical, rest on a spacer. The diameter of the tubes is such that they wedge between the vertical sections of the bent tubular elements and such that clamps 23 and 24, positioned near the ends of the sockets, hold the sockets in place, press the sockets against the bent tubular elements and press the bent tubular elements against the spacers to cause them to clamp around the straight tubular element to hold the tiers in position.

Figure 5:
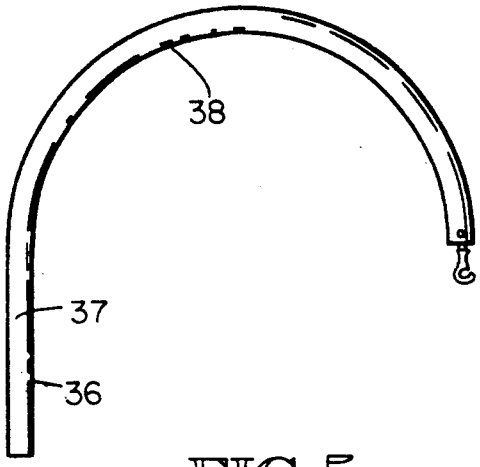
FIG. 5 illustrates the limb used in the lower and intermediate tiers.

FIG. 5 illustrates a preferred configuration of limb 36 for use in the bottom and intermediate tiers. It is tubular and comprises a straight socket segment 37 and an arched limb segment 38 having an arc length of approximately 180°, this being typical for all the limbs in a preferred embodiment.

Figure 6:
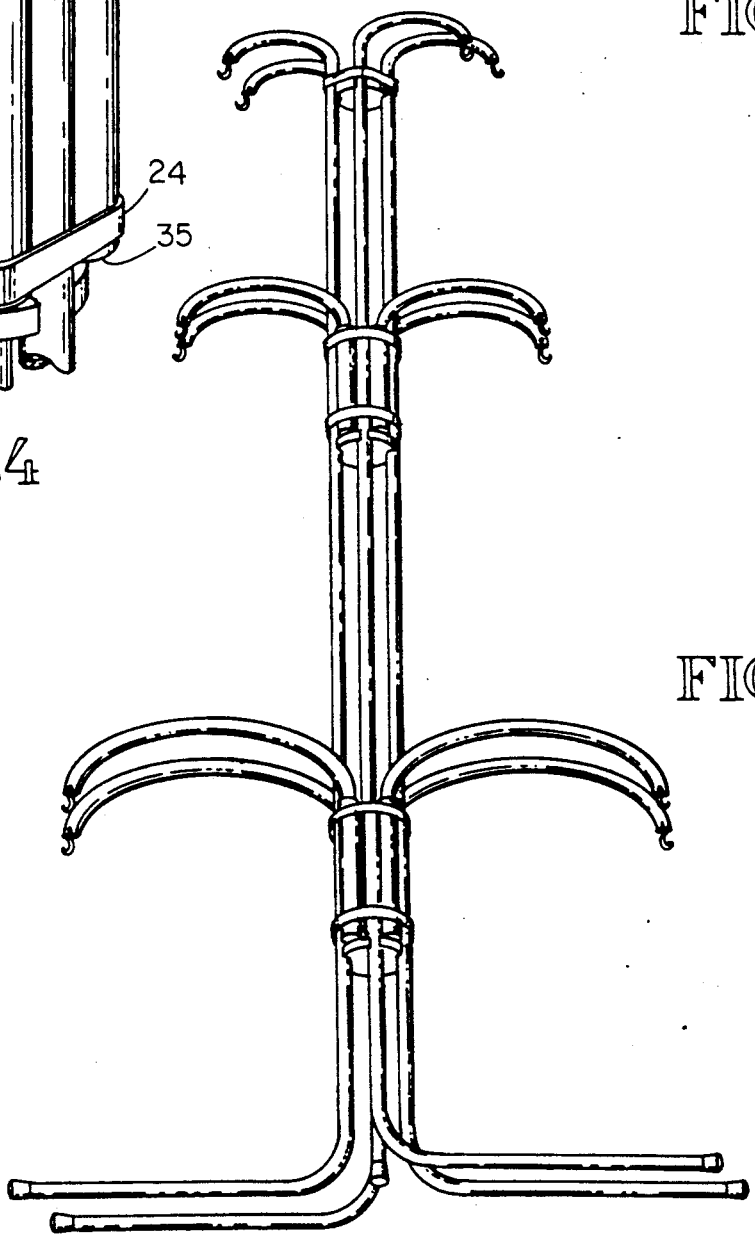
FIG. 6 schematically illustrates the stand folded flat for storage or shipment fully assembled.

FIG. 6 illustrates in perspective the structure folded flat for storage or shipment fully assembled.

It is believed understandable from this description that the invention meets its objectives. It provides a tree-like structure for hanging plants. The structure is foldable with no disassembly into a flat configuration. All of the parts except the spacers are either commercially available or made by cutting and bending tubing. The spacer is a simple plastic molding.

It is also considered to be understandable that while one embodiment of the invention is described herein, other embodiments and modifications of the one described within the scope of the subject invention which is limited only by the attached claims.

I claim:

1. A tree-like structure for supporting hanging plants, said structure having a base, a vertical section and a plurality of tiers of limb-like structures, said plurality comprising a bottom tier, a top tier and at least one intermediate tier, said structure further comprising:

a plurality of bent tubular elements, each element comprising a vertical portion having first and second ends and a base portion normal to said vertical portion at said first end and a limb-like portion at said second end, said base, vertical and limb-like portions lying in a plane, a straight tubular element, a plurality of spacers, each spacer being a wafer having a center and a periphery and a hole at said center and notches equally spaced around said periphery, a plurality of hose clamps, a plurality of sockets, each having a longitudinal axis and first and second ends, a plurality of limb-like structures, each structure comprising a straight socket segment and a limb-like segment having a free end, a plurality of hooks, said straight tubular element being inserted through said holes in said centers of said spacers said spacers being positioned along said straight tubular element, said bent tubular elements being installed one each in said notches in said peripheries of said spacers with said base portions in a plane and in a cruciform configuration, each of said sockets being installed with said first end on a spacer and said longitudinal axis parallel to said vertical portions, said sockets being wedged against said vertical portions, said hose clamps being installed around said bent tubular elements and said sockets near said spacers and near said first and second ends of said sockets, said limb-like structures being installed one per each of said sockets with said straight socket segments in said second ends of said sockets whereby said limb-like segments form said bottom and intermediate tiers of limb-like structures, said hooks being attached to said free ends of said limb-like segments of said limb-like structures.

* * * * *